US005255744A

United States Patent [19]

Silva

[11] Patent Number: 5,255,744

[45] Date of Patent: Oct. 26, 1993

[54] SUBSEA PRODUCTION SYSTEM AND METHOD FOR LINE CONNECTION BETWEEN A MANIFOLD AND ADJACENT SATELLITE WELLS

[75] Inventor: José E. M. Silva, Rio de Janeiro, Brazil

[73] Assignee: Petroleo Brasileiro S.A. Petrobras, Rio De Janeiro, Brazil

[21] Appl. No.: 775,900

[22] Filed: Oct. 15, 1991

[30] Foreign Application Priority Data

Oct. 12, 1990 [BR] Brazil ..... 9005129

[51] Int. Cl.[5] ..... E21B 43/013

[52] U.S. Cl. ..... 166/347; 166/366; 405/169

[58] Field of Search ..... 166/366, 347, 339, 360, 166/352, 353; 405/169

[56] References Cited

U.S. PATENT DOCUMENTS

| | | | |
|---|---|---|---|
| 4,075,862 | 2/1978 | Ames | 166/347 X |
| 4,175,620 | 11/1979 | Nolan, Jr. et al. | 166/343 |
| 4,211,281 | 7/1980 | Lawson | 166/345 |
| 4,310,263 | 1/1982 | Daughtry | 405/169 |
| 4,367,980 | 1/1983 | Ames et al. | 405/169 |
| 4,378,848 | 4/1983 | Milberger | 166/366 X |
| 4,398,846 | 8/1983 | Agdern | 166/366 X |
| 4,541,753 | 9/1985 | Langner | 405/169 X |
| 4,671,702 | 6/1987 | Langner | 405/169 |
| 5,040,607 | 8/1991 | Cordeiro et al. | 166/366 |

*Primary Examiner*—Hoang C. Dang
*Attorney, Agent, or Firm*—Sughrue, Mion, Zinn Macpeak & Seas

[57] ABSTRACT

A subsea production system effects line connections between a manifold and adjacent satellite wells. The radial distance between each well (37) and a central manifold (38) is reduced to an operational minimum. The manifold is provided with connection terminals (45) including at a lower portion, a hydraulic type connector (47), and at an upper portion a reentry mandrel (50). A supporting structure (53) of the connection terminal (45) consists at the lower portion of a mud mat (54) centrally of a waiting mandrel (55). A lateral structure (56) is provided at an upper portion with eyelets (57), and the upper portion mounts a reentry funnel (58). Various methods are effected for completing line connections between such a manifold (38) and adjacent satellite wells (37).

8 Claims, 15 Drawing Sheets

SUBSEA PRODUCTION SYSTEM AND METHOD FOR LINE CONNECTION BETWEEN A MANIFOLD AND ADJACENT SATELLITE WELLS

FIELD OF THE INVENTION

This invention refers to a subsea petroleum system in which the production from various wells is grouped in one single unit or manifold and in which the distance between each well and the manifold is reduced to an operational minimum; the invention includes also the methods for line connection between that manifold and the adjacent wells.

DESCRIPTION OF THE PRIOR ART

In the 70's, the petroleum industry started adopting the production of subsea wells and, as a consequence, wet christmas trees were developed. In the beginning, the production from various satellite wells was collected into a central manifold, usually installed on a platform, and transported therefrom to floating production storage units or to fixed platforms.

With the discovery of large fields in deep waters, the petroleum industry started adopting central collecting systems for subsea production as an economically more feasible option for the production development of those fields.

For economic reasons, the usual practice has been to group the production from various wells through two main systems: a manifold and a manifold-template. In the first one, the wells are drilled from independent bases and located at minimum distances from the manifold of nearly 300 m. Between the wells and the manifold, independent subsea lines are used. From the manifold, the lines to a surface production unit are common. This provides an economic advantage. In the second system, the wells are drilled from one single structure, offering as a main advantage the economy in subsea lines between wells and a manifold, as well as in the connection operations of those lines. In this case, the manifold is coupled to a drilling guide-structure or template. The advantages of the manifold-template, however, are accompanied by various limitations, aggravated as the water depths become larger and larger and where vessels equipped with dynamic positioning are utilized in place of anchored platforms. In these cases, it is of fundamental importance to increase the distance between wells to reduce the risks of collision between equipment units with serious environmental and economic consequences.

With the purpose of assisting the exploitation of deep-water reservoirs, the state of the art considers the use of manifolds with wells located at large distances, that is, in the range of 300 m or more. Christmas trees are preferably of lay-away type, that is, they are installed already connected to the flow lines, so as to reduce the line-connection operations which would be performed in the other extremity, that is, in the manifold. This technical solution, however, presents a disadvantage of an economic nature as a function of the line lengths utilized and of operational safety, since long line sections lead to the need for simultaneous utilization of two dynamic-positioning vessels: the rig and the lay barge.

The state of the art considers also, PI 8806661, a manifold-template which branches off radially from a central foundation on which the structure is set so as to remain in non-contact with the marine ground and on which is located the central manifold for well production controls. Each arm of the structure has in its extremity an opening for adaptation of a guide-base to allow for well drilling and structure attachment. One of the structure arms is intended to receive the connectors of the export lines and of the well-control lines.

Structures of the above-mentioned type, however, present, as major disadvantages, the fact that the manifold-template incorporates structures of large dimensions, such as arms to provide distances trying to make feasible the operation with dynamic-positioning vessels and minimize the large risk involved in those operations.

BACKGROUND AND ADVANTAGES OF THE INVENTION

Differently from the manifold-templates which incorporate structures of large dimensions, such as arms, the system hereunder proposed, according to this invention, offers as advantages, in relation to the manifold-template mentioned above, the full flexibility in relation to the slope of the sea-bottom, without the need for the provision of alignment devices to correct deviations in well drilling, such as universal joints, loops and active connectors between the wet christmas tree (WCT) and the manifold-template. This invention is free from problems caused by drilling cuttings, without the need for the provision of equipment for debris dispersion, or space for the accumulation of debris which imply the separation of the manifold-templates from the ground. The invention allows for early drilling in relation to template installation, which renders the system advantageous even in water depths allowing for the use of guide-cables. The present invention does not require the provision of contingency mouths, since the wells do not integrate the structure. The apparatus of the invention allows for easy access of ROV for inspection and operation of valves in the manifold and in the WCTs as a function of the distance between the same. The subsea production system allows for higher operational safety, as a function of the larger distance between the WCTs and the manifold, thereby drastically reducing the risk of damages caused by collision and dropping of objects, particularly in operations without guide-cables. The system of the invention presents a simpler structure, by not requiring arms, nor suffering from the influence of stresses originating from the wells. the system allows for simpler operation with lower costs, even of the drilling rig itself. In certain cases the system does not require piling or levelling. The elements of the system may be set on the sea-bottom, which allows, in opposition to the use of templates, the retrieval of the elements at the end of the project, leaving the sea-bottom clear and permitting reinstallation in another location, or upon retrieval, maintenance of the components. The connection between the satellite wells and the manifold depends upon the height of the manifold structure in relation to the marine ground. The traditional methods of connection, such as pull-in, are significantly impaired by the structure height of the manifold structure. The connection between the satellite wells and the manifold is little affected by the configuration of the marine ground. A larger number of wells may be interconnected to the system for identical dimensions to that of a manifold-template with arms, since the area required for connecting a satellite well to the manifold by the methods hereunder proposed is much smaller than the area occupied by a well of the template. The invention permits utilization of flexible lines of lower cost, due to the expectancy of stresses which are much smaller than those of the traditional lay-away methods which involve large line lengths. The system utilizes christmas trees used in satellite wells and already tested in large water depths, etc.

In comparison with a manifold with satellite wells located at large distances, the system hereunder proposed offers the major advantage of economy in lines and installation costs, as well as reducing drastically, the risks of paraffin deposition in the lines as a function of the reduced line length exposed to the low sea-bottom temperatures in large water depths.

SUMMARY OF THE INVENTION

It is, therefore, the object of this invention to provide a subsea production system in which the radial distance between each well and the manifold shall be reduced to an operational minimum, possibly less than 50 m, offering the advantages previously mentioned, including a base-structure which can be directly set on the marine ground. The lines of the adjacent satellite wells connected to the base-structure may or may not contain the manifold. Such manifold may consist in structures, pipes, check valves, valve modules and control system connection lines, connectors for the valve modules and valves and chokes, as well as terminals for interconnection to valve modules. The manifold may further include maneuver valves, chokes and pressure transducers. A system for connection of the lines of the satellite wells promotes the interconnection of the satellite wells to the manifold,, may contain christmas trees of the satellite wells, preferably of the usual lay-away type, interconnection lines connecting the satellite wells to the manifold and being of flexible or rigid type provided with flexible extremities, as well as connecting terminals.

The connection terminals utilized in the system and forming one object of this invention consist, according to a first embodiment, of a connector of the hydraulic type, presenting laterally, a plate for connection to the lines of the satellite well. The connecting terminal should be equipped with bending restrictors and eventually with shearing devices and, at the top, with a reentry mandrel. The terminal should be also provided with a supporting structure consisting of a mud mat, waiting mandrel, lateral structure, eyelets for structure retrieval, and a reentry funnel.

A second embodiment of a connection terminal utilized in the system and forming an object of this invention includes a connector of the hydraulic type presenting laterally, a plate for connection to the lines of the satellite well, and should be equipped with bending restrictors and, eventually, with a shearing device, at the top with a reentry mandrel and, upper and lower reentry funnels to make easy, respectively, the retrieval and the installation of the terminal. The terminal should be also provided with a supporting structure consisting of a mud mat, waiting mandrel and eyelets for structure retrieval.

This invention is directed as well, to the methods for line connection between the manifold and the adjacent satellite wells at the system.

BRIEF DESCRIPTION OF THE DRAWINGS

These objects, characteristics and advantages of this invention shall become hereafter more apparent as from the following detailed description together with the drawings which integrate this specification, in which.

BRIEF DESCRIPTION OF THE INVENTION

Figure 1A:
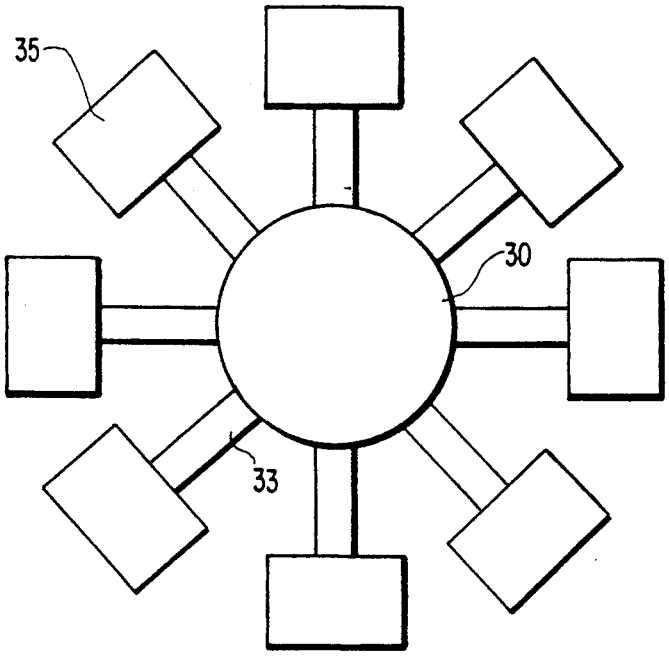
FIG. 1A PRIOR ART
FIGS. 1A and 1B are schematic top plan views of a manifold-template with arms and manifold with distant satellite wells, according to the prior art.
Figure 1B:
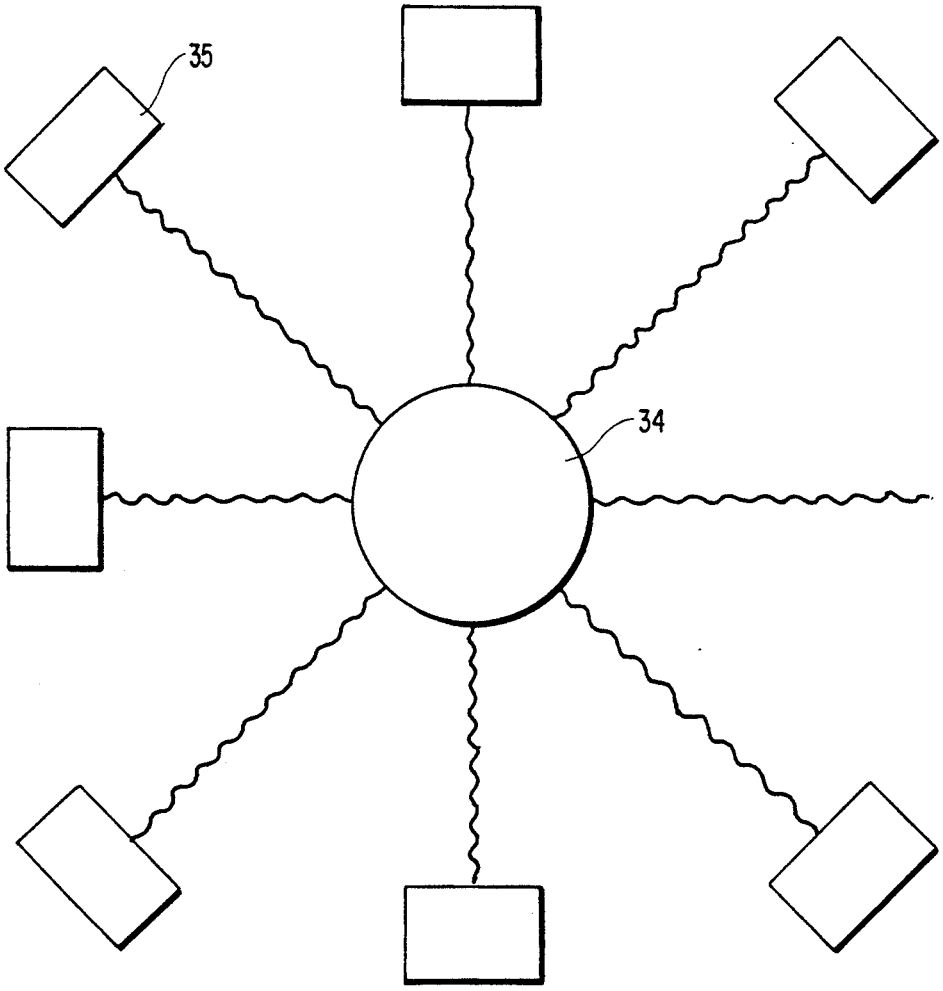
FIG. 1B PRIOR ART

FIGS. 1A and 1B illustrate the manifold-template 30 of the state-of-the-art, incorporating structures of large dimensions, such as arms 33 to provide distances between a manifold template 30 and a plurality of satellite wells trying to make feasible a safe operation with dynamic-positioning vessels and that of the manifolds 34 already connected to the satellite wells 35 at large distances.

Figure 2:
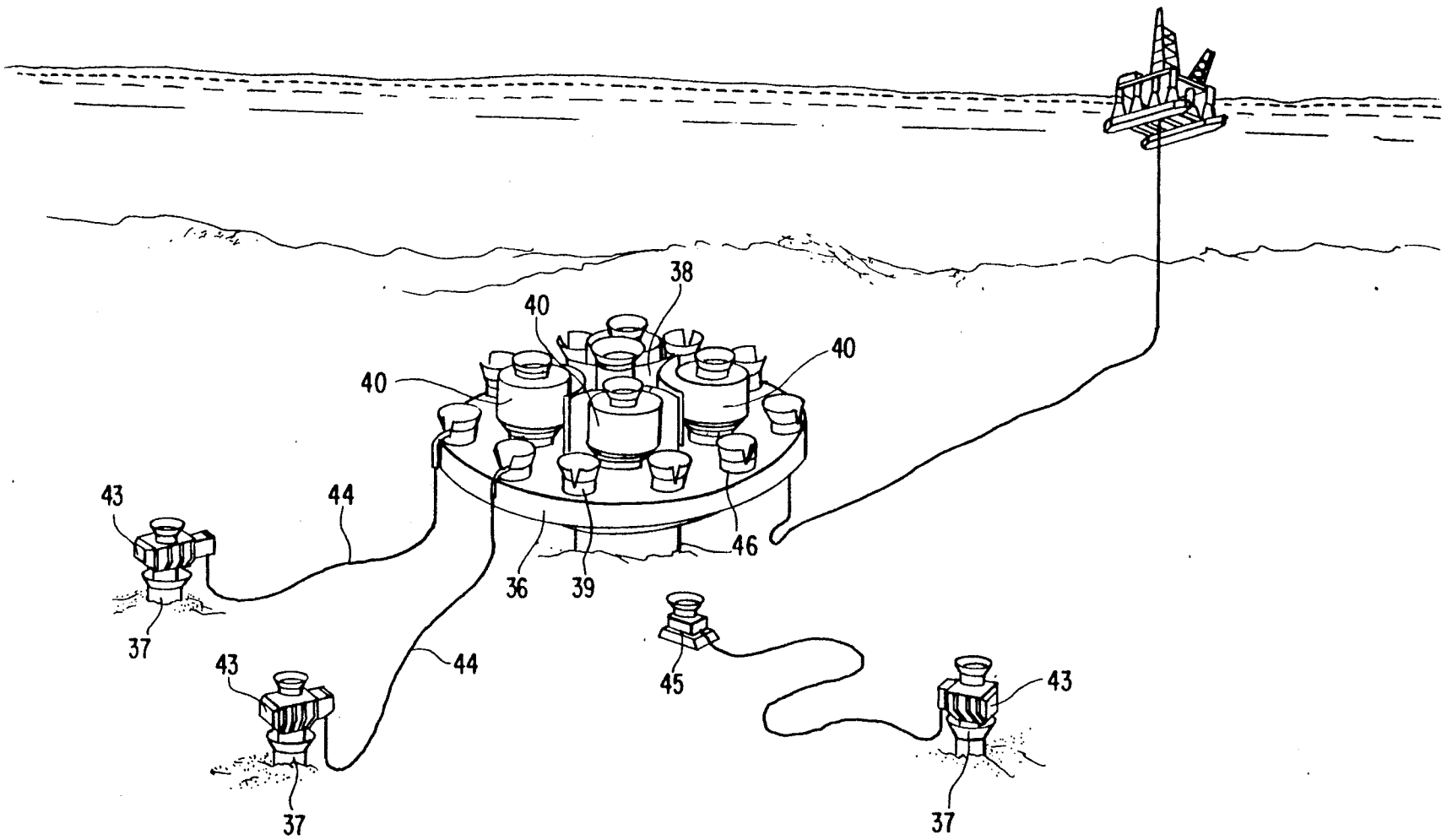
FIG. 2 is an enlarged perspective view of a subsea production system with the improvements of this invention.

As it can be inferred from FIG. 2, the subsea production system, according to this invention, includes:

a base-structure 36 which can be piled or directly set on the marine ground, may contain a manifold 38, and may also be removed, in case of damage, for maintenance;

a manifold 38 consists of structure, pipes, check valves, modules and lines of a control system, in addition to terminals 39 for interconnection of valve modules or chokes 40 and also of connection bases 46;

adjacent satellite wells 37 are preferably equipped with wet christmas trees 43, of the lay-away type;

connection terminals 45; and a connection system allows for the interconnection of said satellite wells 37 to the manifold 38 by means of flexible or rigid lines 44 provided with flexible extremities or ends.

It must be pointed out that the base-structure 36 may be removed, in case of severe damage, for maintenance. This also makes it possible to leave the sea-bottom clear, at the end of the project's life. The manifold 38 may or may not be retrievable. In case the manifold is retrievable, the pipes, control lines, check valves, connectors, etc., may be brought back to the surface for maintenance purposes. In case the manifold is not retrievable, those components are integrated to the base-structure 36. The modules of valves or valve modules 40 contain maneuver valves, chokes and pressure transducers, each serving one or more wells. The removal of one of them for maintenance does not result in full production stoppage. Their dimensions are preferably limited to the handling capacity of the drilling rig. Alternatively, maneuver valves, chokes and transducers may integrate the WCTs, largely simplifying the manifold. All the operations are performed without the use of guide-cables.

Figure 3:
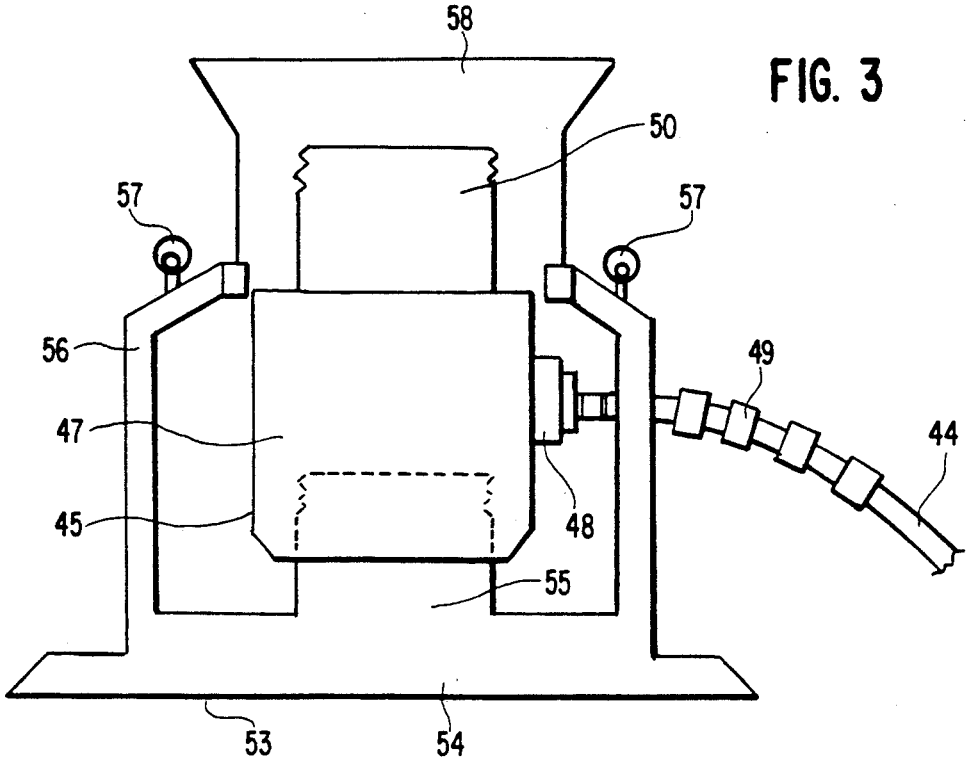
FIG. 3 is a sectional view of a connection terminal and its supporting structure utilized in the subsea production system shown on FIG. 2, according to a first embodiment of the invention.

As it may be seen from FIG. 3, the connection terminal 45 utilized in the subsea production system, according to a first embodiment, includes at a lower portion a hydraulic type connector 47 with hydraulic secondary and mechanical tertiary unlocking. The connector 47 is provided with accesses for the production and annulus lines, hydraulic control lines and electric cable, for connection to the terminal of the manifold. The connection terminal 45 is provided laterally with a swivel 48 for connection to the lines 44 of the satellite well 37, which line 44 is equipped with bending restrictors 49 and, eventually, with shearing pieces. The connection terminal is provided at an upper portion with a reentry mandrel 50. A supporting structure 53 for protection and access to the connection terminal 45 consists of a lower portion of a mud mat 54 for setting the terminal 45 on the marine ground and centrally at an upper portion of a waiting mandrel 55 for support of the connection terminal 45. The supporting structure 53 also prevents cuttings from entering the terminal 45. A lateral structure 54 is integral with the supporting structure and is provided at the top with eyelets 57 for facilitating retrieval of the supporting structure 53 after the installation of the connection terminal 45 at the connection base 46 of the manifold 38. The connection terminal 45 connects at the top via reentry mandrel 50 with an upper reentry funnel 58 to render easy the retrieval of the connection terminal 45.

Therefore, the subsea production system, as an object of this invention, includes:

A base-structure 36 which may be set on piles or set directly on the marine ground, may contain a manifold 38, and may also be removed in case of damage, from the ground for maintenance purposes.

A manifold 38 of the system consists of structure, pipes, check valves, modules and lines of a control system, in addition to terminals 39, FIG. 2, for interconnection of valves and chokes 40, and also of connection bases 46.

Adjacent satellite wells 37 are preferably equipped with wet christmas trees 43, of the lay-away type, which may contain maneuver valves, chokes and transducers.

Connection terminals 45 consisting, in their lower portion, of a hydraulic type connector 47 are provided laterally with a swivel 48 for connection to the lines 44 of the satellite wells 37, the lines 44 being equipped with bending restrictors 49 and, in their upper part, of a reentry mandrel 50.

Supporting structure 53 of the connection terminals 45 consists of a lower mud mat 54, a central waiting mandrel 55, and a lateral structure 56. The structure 53 is provided with eyelets 57 and upper reentry funnel 58.

A connection system is provided with flexible extremities allowing for the interconnection of the satellite wells 37 to the manifold 38 by means of flexible or rigid connection lines 44.

Figure 4:
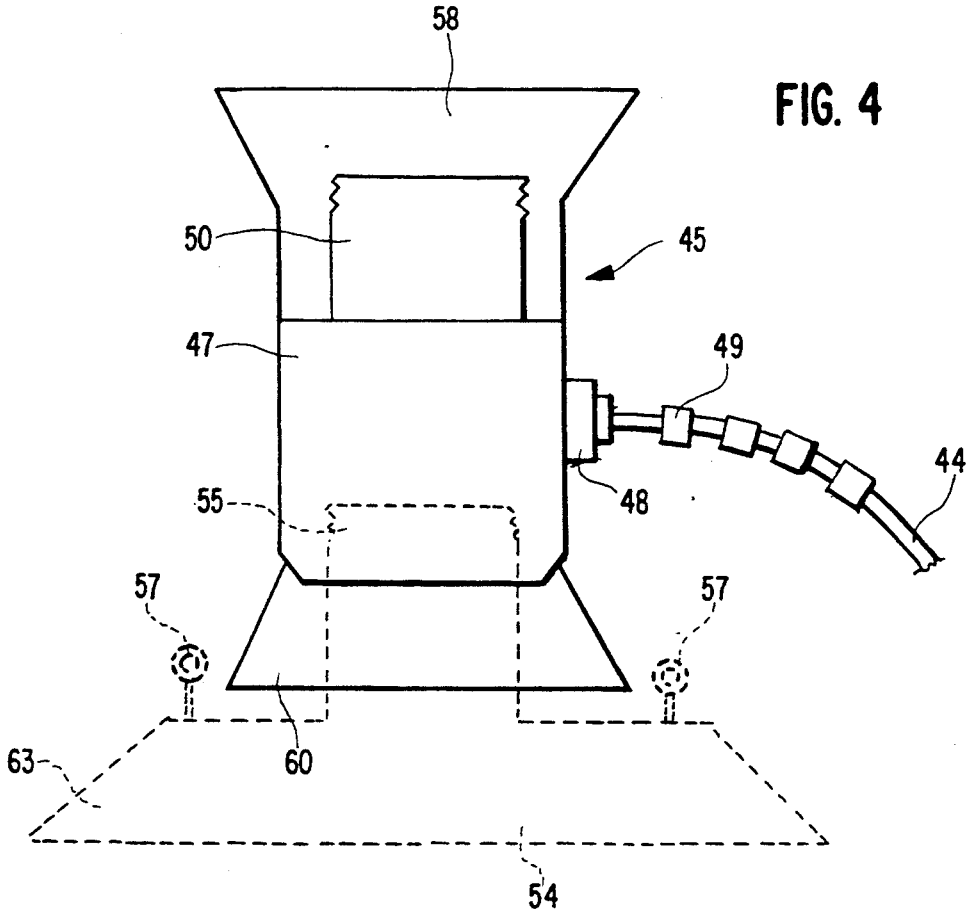
FIG. 4 is a sectional view of a connection terminal and its supporting structure utilized in the subsea production system shown on FIG. 2, according to a second embodiment of the invention.

Moreover, according to a second embodiment, FIG. 4, the connection terminal 45 includes a hydraulic type connector 47 with hydraulic secondary and mechanical tertiary unlocking. The connector terminal 45 is provided with accesses for the production line and annulus, hydraulic control lines and electric cable, for connection to the terminal of the manifold. Connector 47 is equipped laterally with a swivel 48 for connection to a respective connection line 44 of one of the satellite wells 37. The line 44 is equipped with bending restrictors 49 and, eventually, with shearing pieces. The connection terminal 45 is provided with a reentry mandrel 50 and an upper reentry funnel 58 and a lower reentry funnel 60, as well as a supporting structure 63 for protection and access to the connection terminal 45. The supporting structure consists, at a lower portion, of a mud mat 54 for setting on the sea-bottom and presents, at the top and laterally, eyelets 57 for facilitating retrieval of the supporting structure 63 after the installation of the terminal 45 at the connection base 46 of the manifold.

The lower reentry funnel 60 and the upper reentry funnel 58 are preferably identical to the top of WCT 43, and the connection terminals 45 present reentry mandrels 50 identical to the top of WCT 43, FIG. 2, so as to allow for the use of a WCT installation tool.

The method for line connection between a manifold 38 and adjacent satellite wells 37 is illustrated on FIGS. 5A through 5H. It must be pointed out either embodiment of connection terminal 45, FIG. 3, FIG. 4, may be utilized, it being necessary to alter only the connection base of the manifold. For purposes of illustration, only the connection terminal 45 according to the first embodiment of the invention, FIG. 3, should be utilized in the connection method hereinafter described.

Figure 5A:
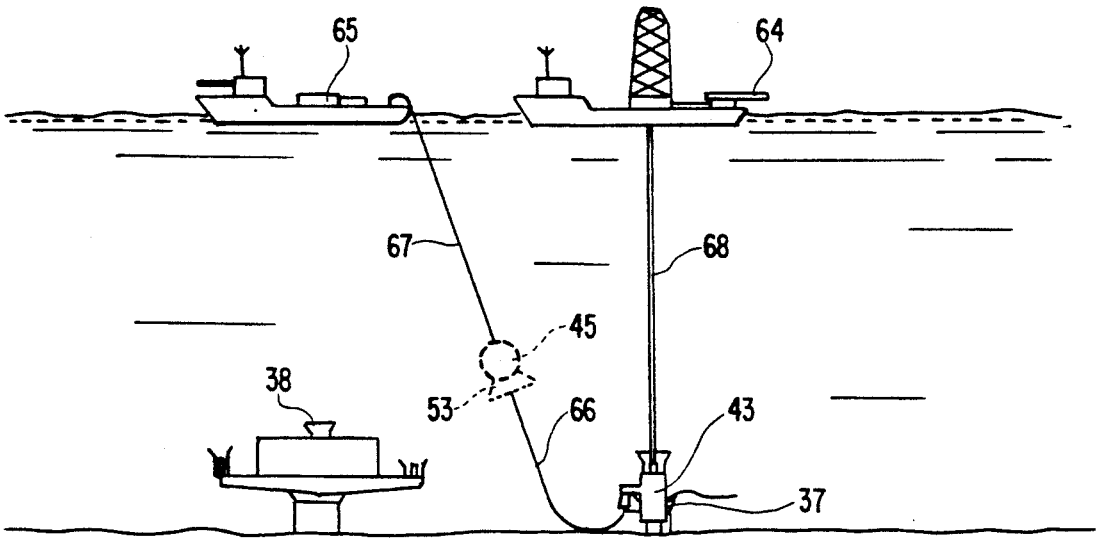
FIGS. 5A through 5H are illustrative views showing the stages of a method for line connection between a manifold and an adjacent satellite well.
Figure 5B:
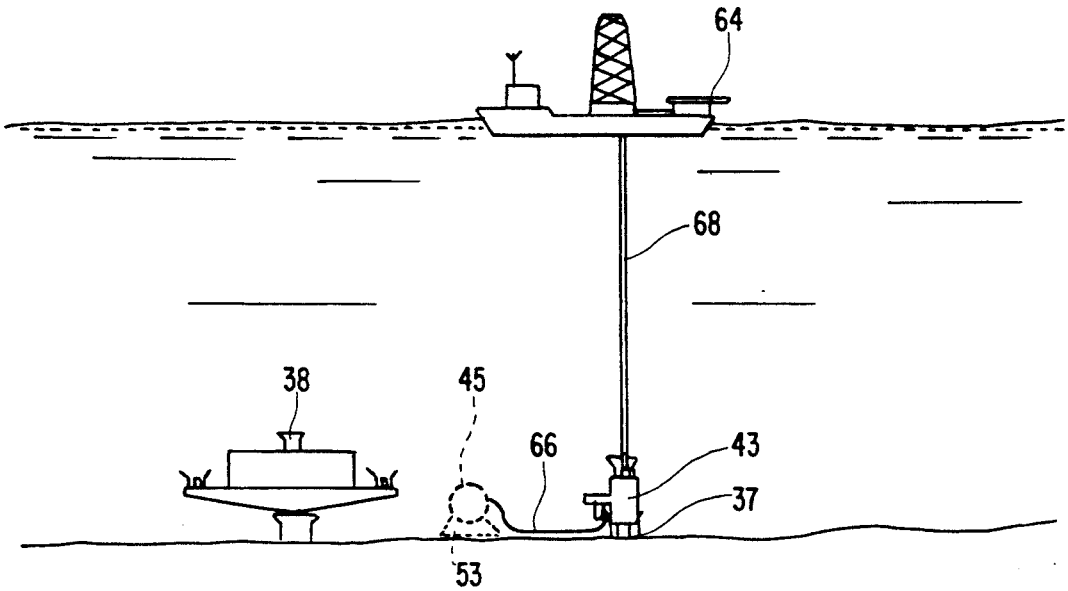
Figure 5C:
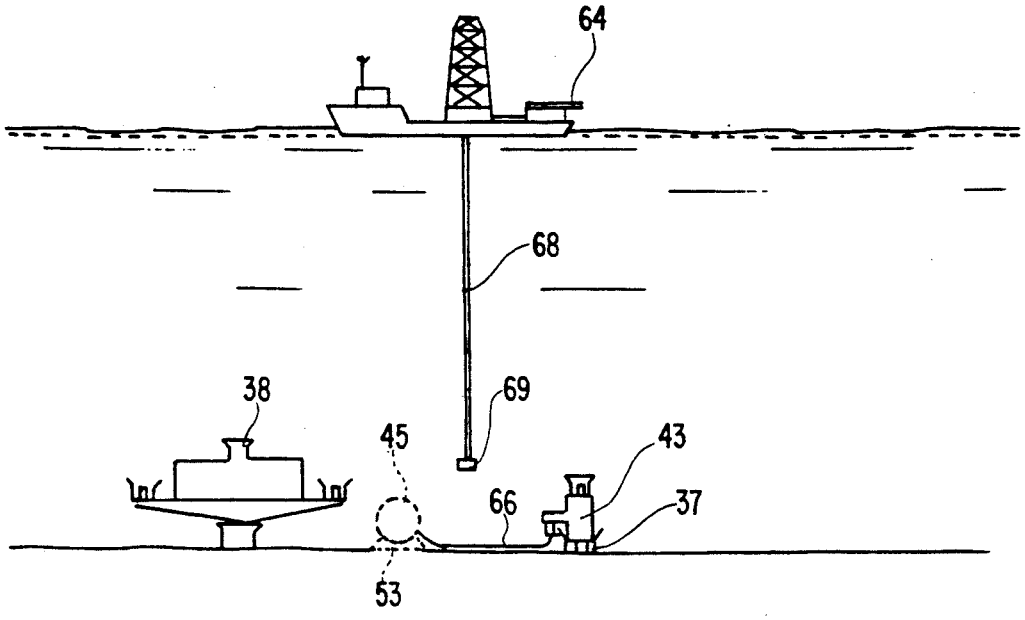
Figure 5D:
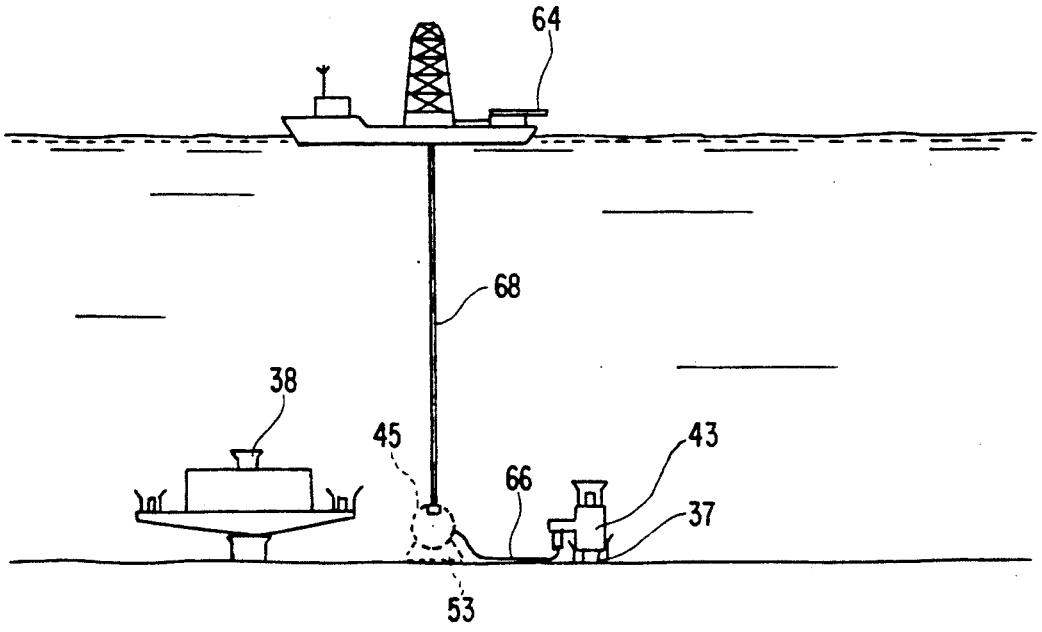
Figure 5E:
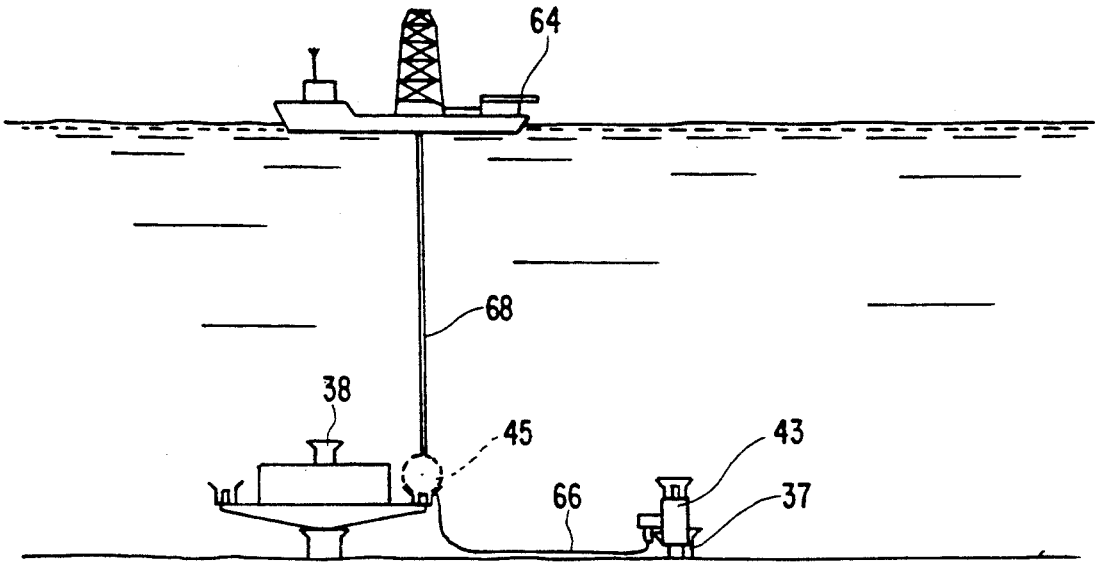
Figure 5F:
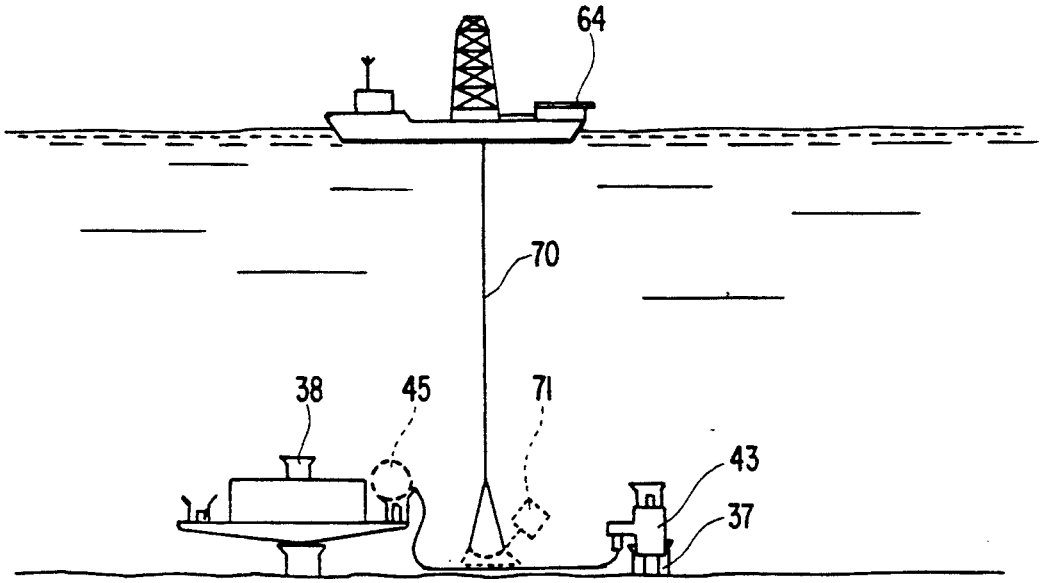
Figure 5G:
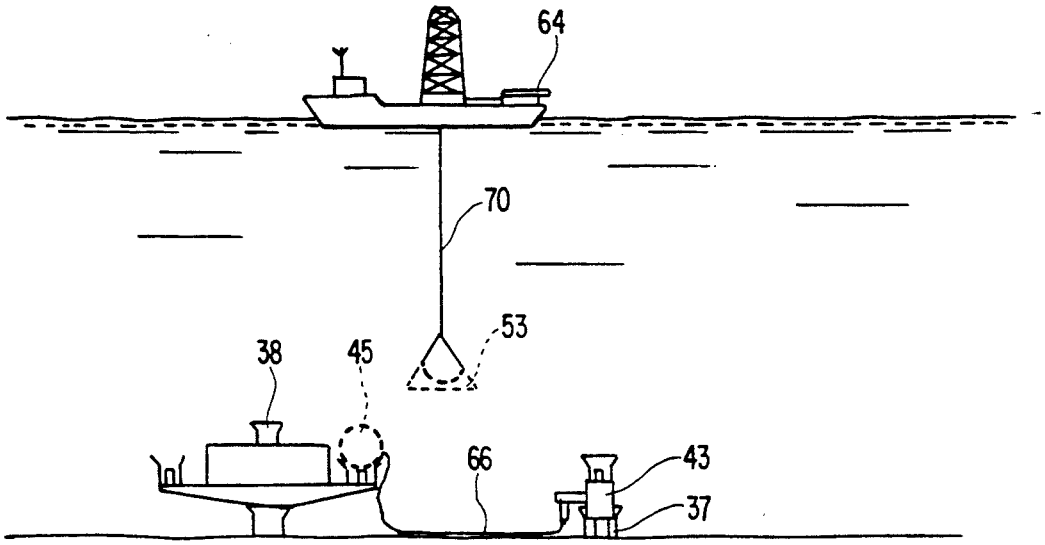
Figure 5H:
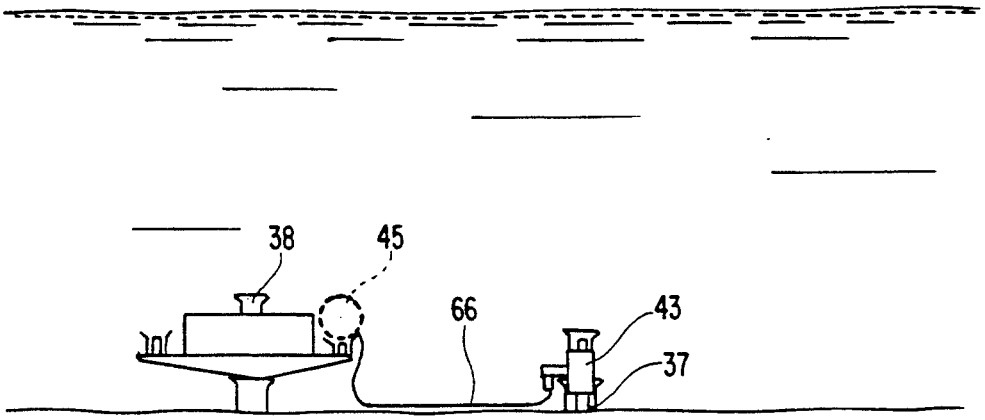

As it can be inferred from FIGS. 5A through 5H, after the installation of the wet christmas tree (WCT) 43 by rig 64 at the satellite well 37, FIG. 5A, the supply boat 65 lays the interconnection or connection lines 66 between an adjacent satellite well and a manifold 38, towards the manifold 38, abandoning them with a connection terminal 45 and their supporting structure 53 in their extremity. There is also illustrated an auxiliary cable 67 and a completion riser 68 (FIG. 5A). After the laying of the lines 66 with the connection terminal 45 in the extremity, the supply boat 65 moves away and the rig 64 remains operating on the WCT 43 (FIG. 5B). Once the completion is ended, the rig 64 moves towards the manifold 38 to fish the connection terminal 45 through the completion riser 68 and the WCT installation tool 69 itself (FIG. 5C). Next the coupling to the connection terminal 45 by the WCT installation tool 69 and the completion riser 68 occurs (FIG. 5D). The connection terminal 45 is hoisted without the supporting structure 53 (retrievable later, with ROV assistance), and coupled to one of the terminals of the manifold 38. The connection is thereafter tested (FIG. 5E). The supporting structure 53 is retrieved by the rig 64 via the cables 70 and with the assistance of ROV 71 (FIG. 5F). The retrieval of the supporting structure 53 by the rig 64 is illustrated in FIG. 5G, the interconnection of the adjacent well 37 to the manifold 38 being then completed (FIG. 5H). It must be pointed out that the supply boat or lay barge 65 is a DP (dynamic positioning) vessel provided with A-frame, since there is no need for vessels of large dimension, in view of the short line section to be handled.

Figure 6A:
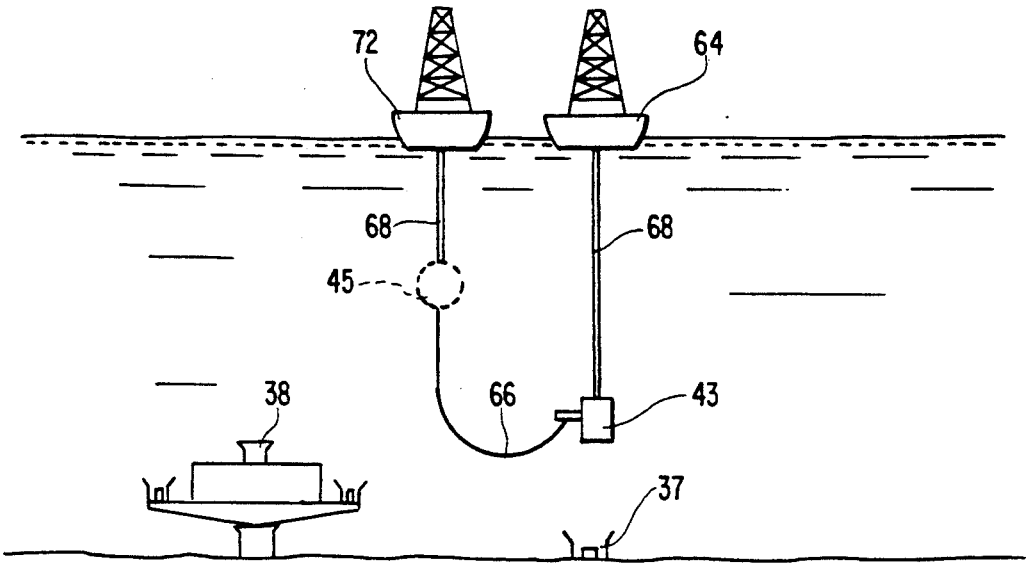
FIGS. 6A and 6B are illustrative views showing the stages of the method for line connection between a manifold and an adjacent satellite well, according to a first alternative embodiment of the invention.
Figure 6B:
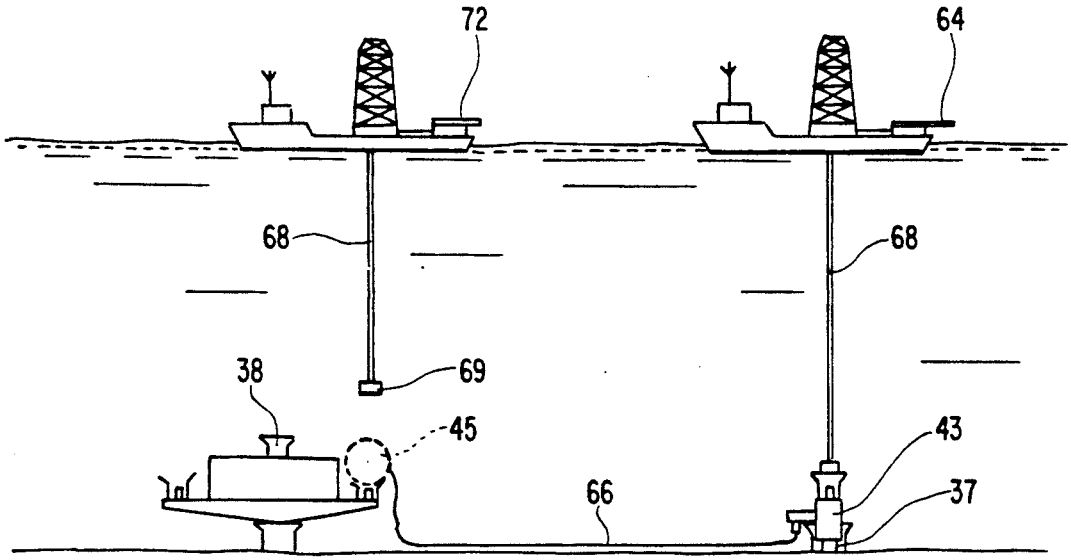

A first alternative embodiment of the connection method of this invention described above, is illustrated in FIGS. 6A and 6B, where, as a replacement to the supply boat 65, a second rig 72 is utilized. In this case, the lowering of the WCT 43 at the head of the well 37 should be simultaneous to that of the connection terminal 45. One may therefore dispense with the supporting structure 53.

Figure 7A:
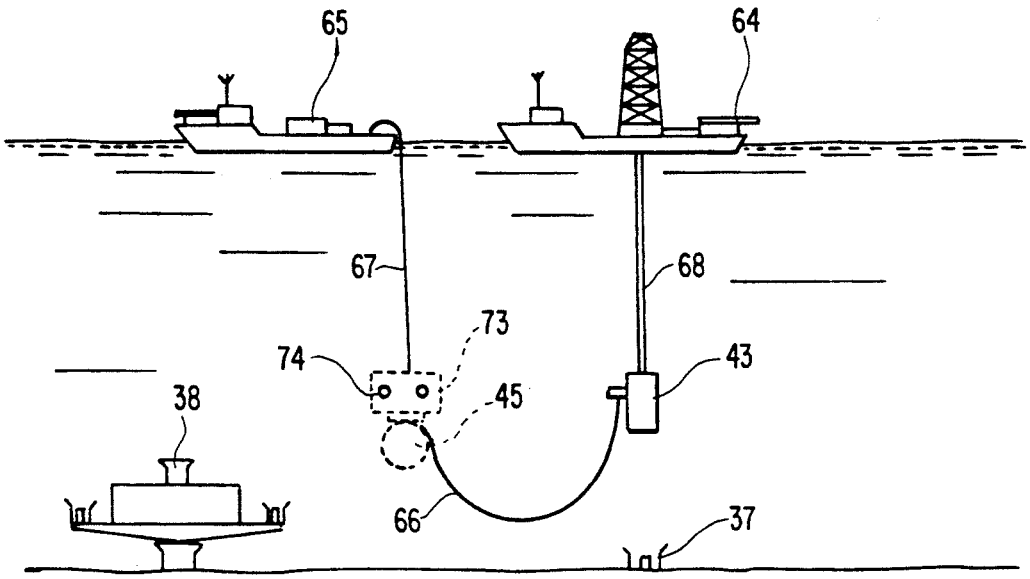
FIGS. 7A through 7D are illustrative views showing the stages of a connection method, according to a second alternative embodiment of the invention.
Figure 7B:
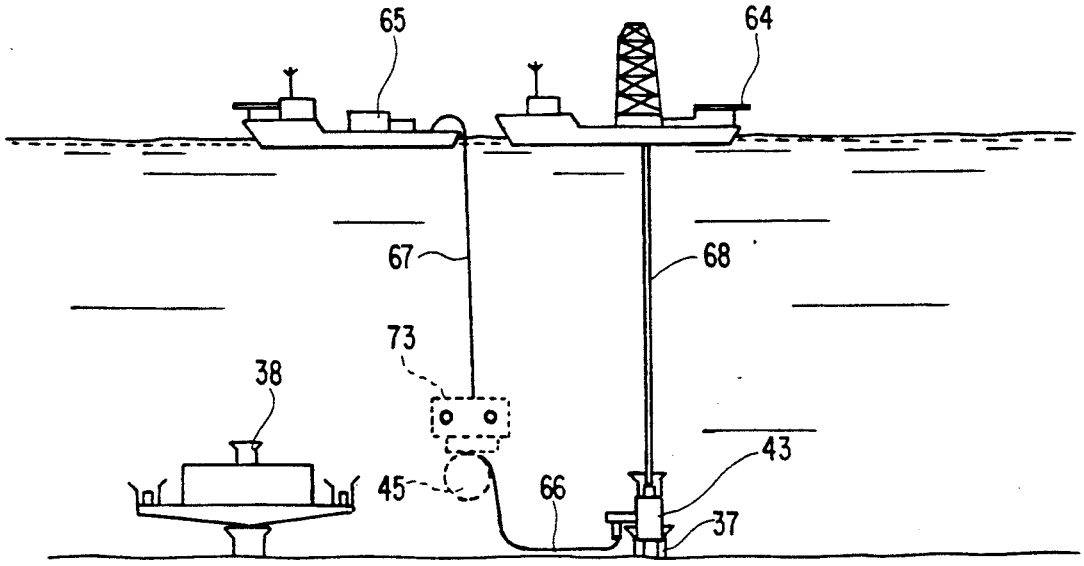
Figure 7C:
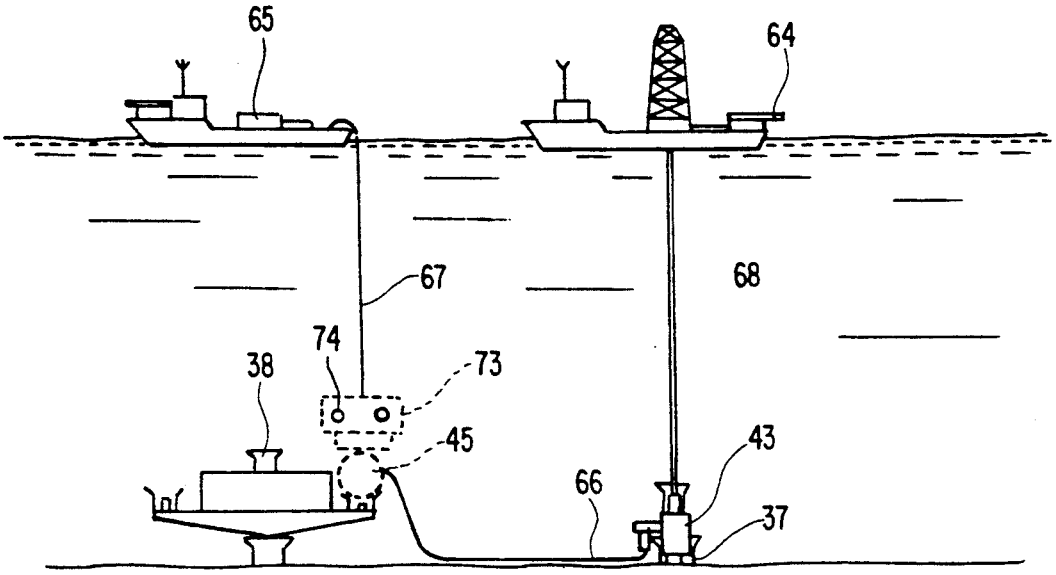
Figure 7D:
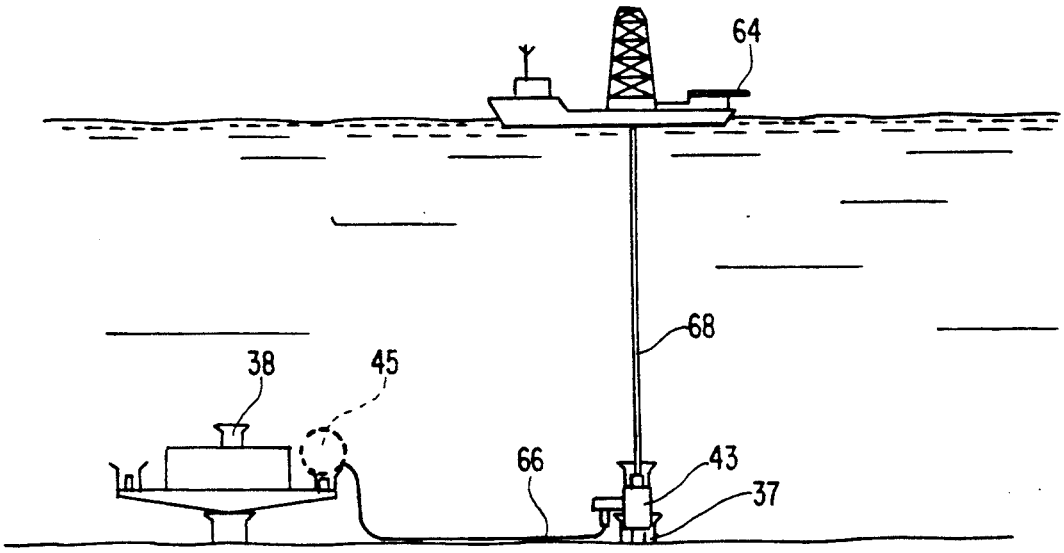

A second alternative connection method is illustrated in FIGS. 7A through 7D, in which the installation of the connection terminal 45 is achieved with the assistance of an operation tool equipped with thrusters. As can be inferred from FIGS. 7A-7D, the rig 64 installs the WCT 43 on well 37 and the connection terminal 45 is hoisted by the remote-operation tool 73 equipped with thrusters 74 by a supply boat 65 (FIG. 7A). After the installation of the WCT 43, the rig 64 works on the well 37 and one section of lines 66 is laid during displacement of the supply boat 65 towards the manifold 38 with the connection terminal 45 hanging from the remote-operation tool 73 of boat 65 (FIG. 7B). The connection terminal 45 is then coupled to the manifold 38 with the final adjustment effected easily by the thrusters 74 of the remote-operation tool 73 FIG. 7C). The completion of the interconnection of the adjacent well 37 to the manifold 38, and the rig 64 is shown connected to the WCT 43 (FIG. 7D).

Figure 8A:
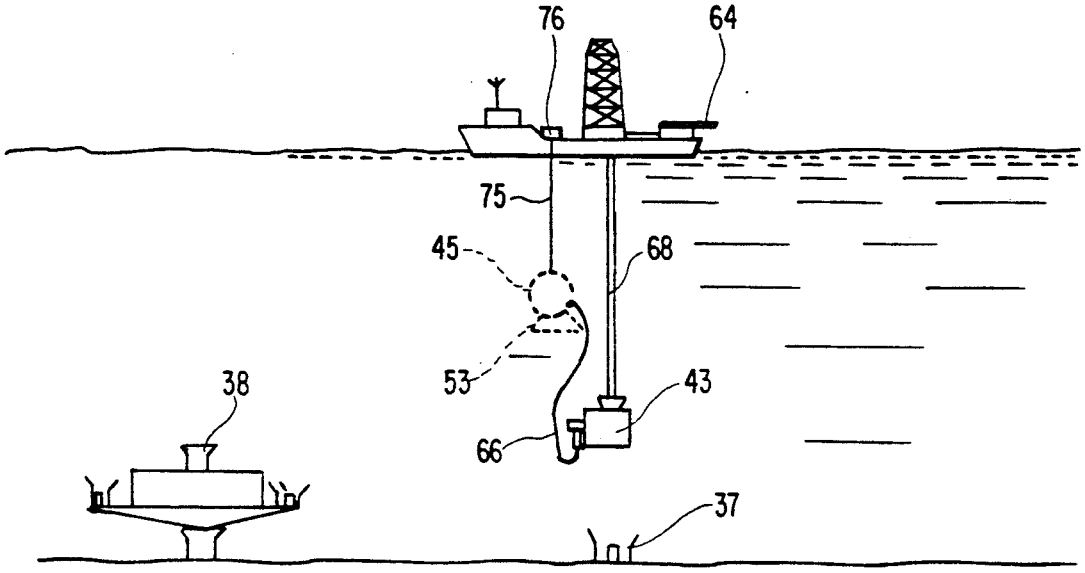
FIGS. 8A through 8H are illustrative views showing the stages of a connection method, according to a third alternative embodiment of the invention.
Figure 8B:
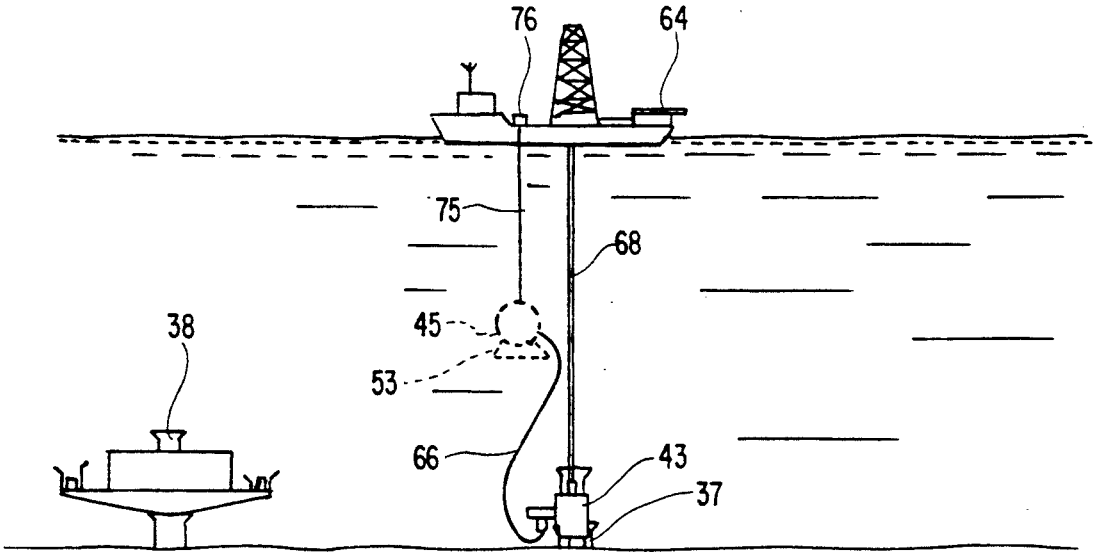
Figure 8C:
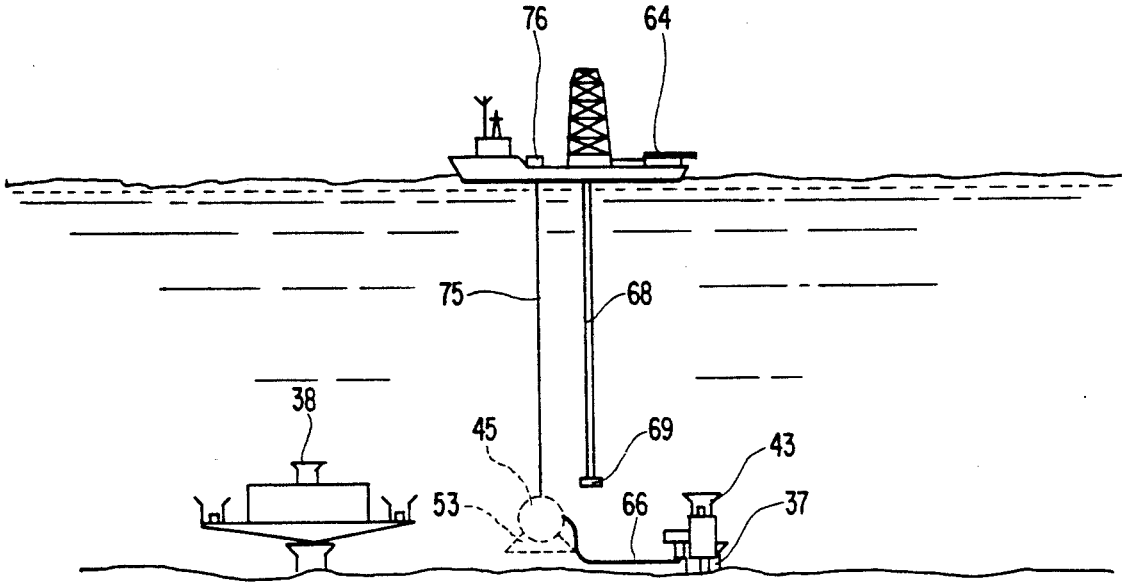
Figure 8D:
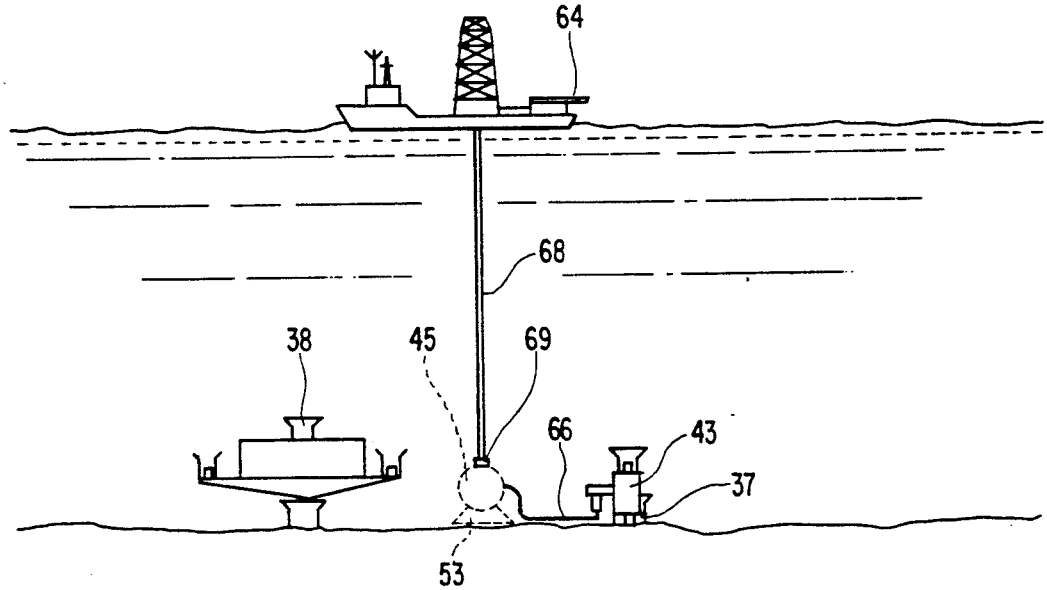
Figure 8E:
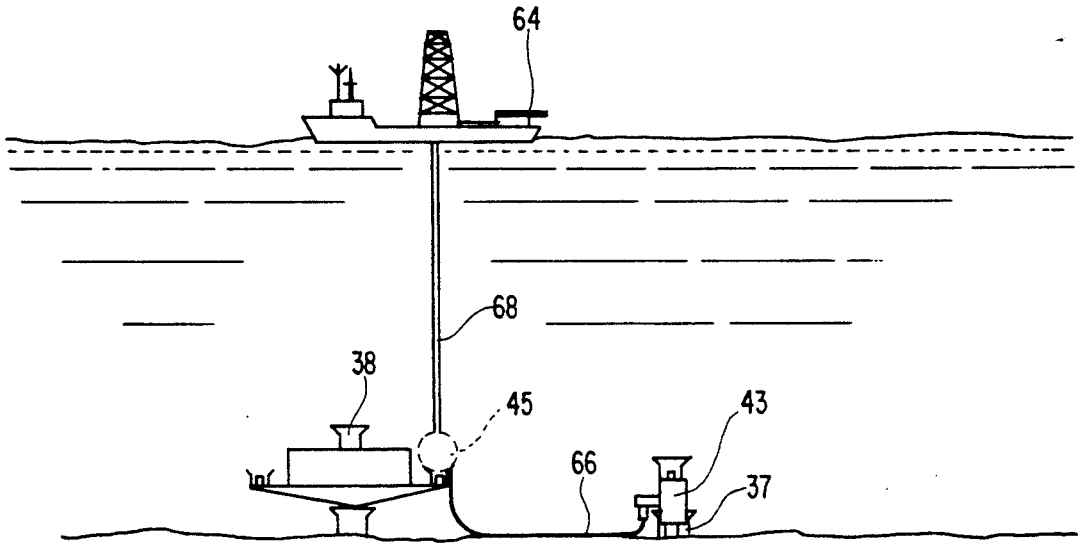
Figure 8F:
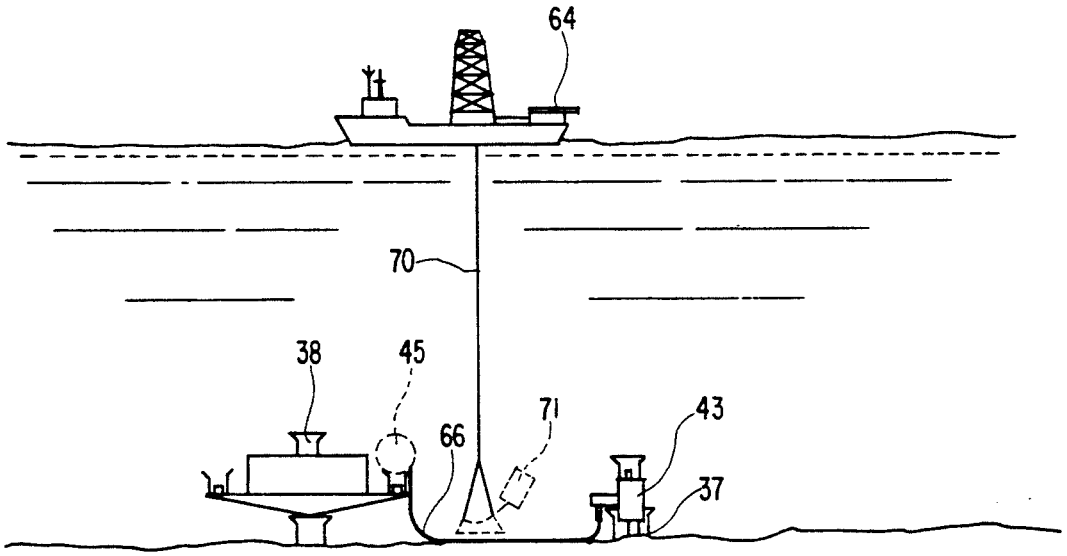
Figure 8G:
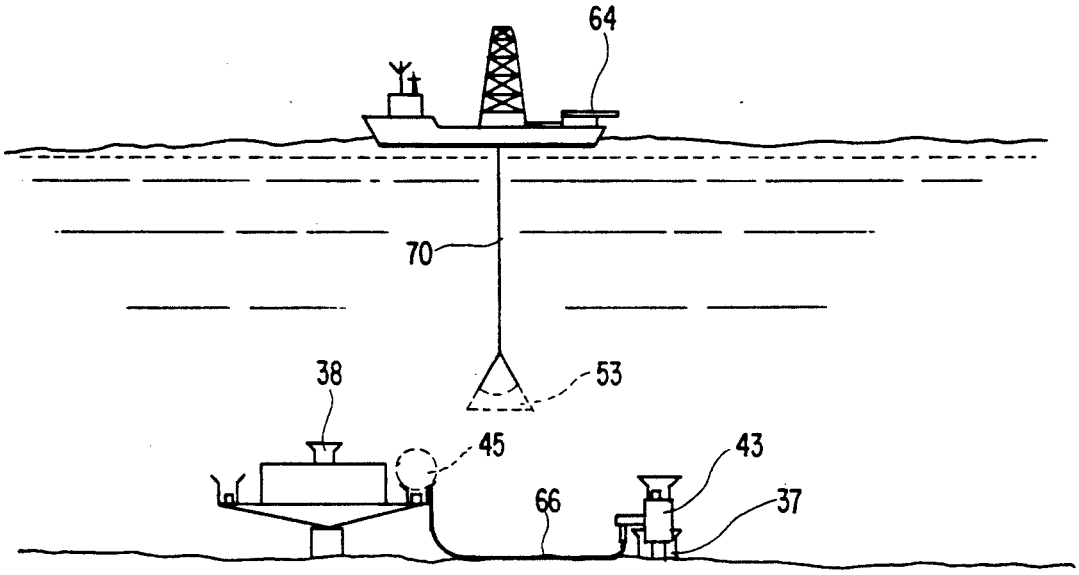
Figure 8H:
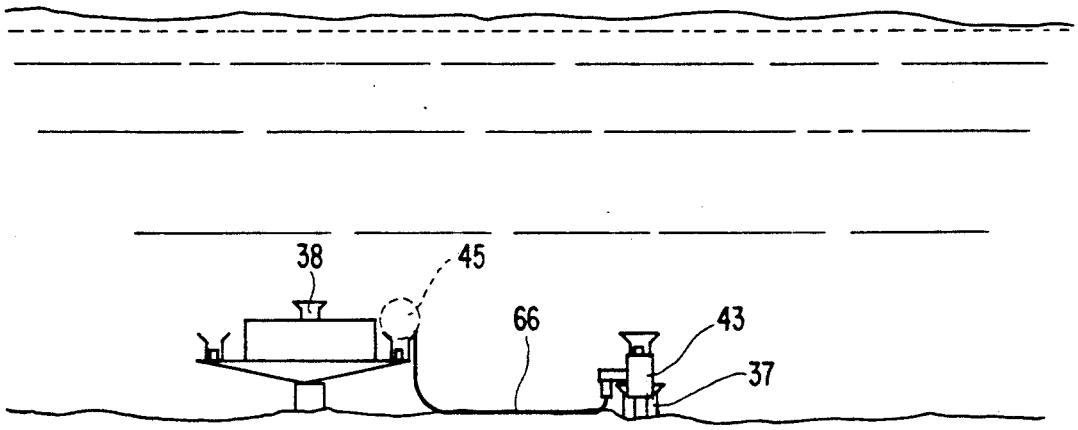

A third alternative connection method is illustrated in FIGS. 8A through 8H, in which a connection terminal 45 and a supporting structure 53 are both hoisted by the rig 64 itself which installs the WCT 43. As it can be inferred from the Figures, the connection terminal 45 and the supporting structure 53 are hoisted by the rig 64 which installs the WCT 43 respectively, by means of an auxiliary cable 68 and by connection terminal 45 to the riser 75 originating from an auxiliary winch 76 installed on board or at the moonpool of the rig 64 (FIG. 8A). The WCT 43 is installed on the well 37 with the connection terminal 45 and the supporting structure 53 hanging from the rig 64 (FIG. 8B). Once the installation of the WCT 43 is completed, the rig 64 next lays the connection terminal 45 with the supporting structure 53 on the marine ground (FIG. 8C). The coupling to the connection terminal 45 by the installation tool of the WCT 69 using the completion riser 68 thereafter occurs (FIG. 8D). The connection terminal 45 is hoisted from the supporting structure 53 via riser 68 and coupled to one of the terminals of the manifold 38. The connection is thereafter tested (FIG. 8E). The supporting structure 53 is then retrieved by the rig 64 using cables 70 and with the assistance of the ROV 71 (FIG. 8F). The retrieval of the supporting structure 53 by the rig 64 is illustrated on FIG. 8G, thereby completing the interconnection of the adjacent well 37 to the manifold 38 (FIG. 8H).

Figure 9A:
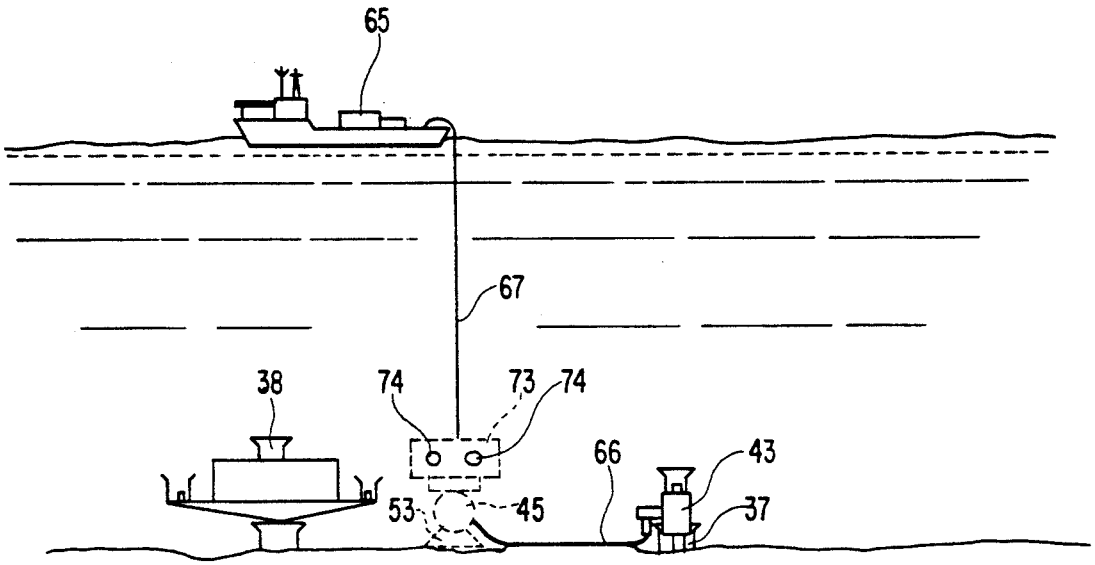
FIGS. 9A and 9B are illustrative views showing the stages of a connection method, according to a fourth alternative embodiment of the invention.
Figure 9B:
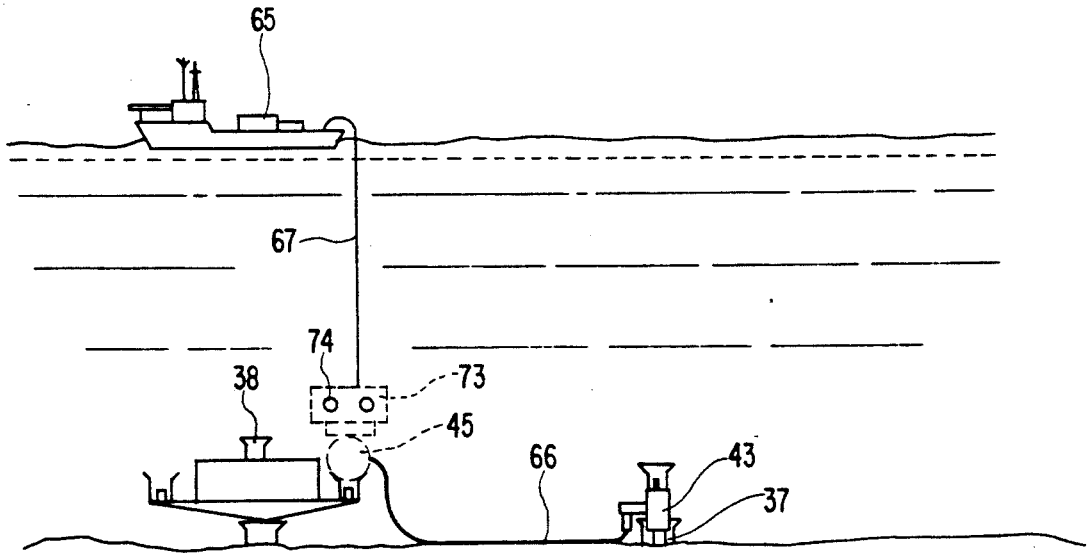

A fourth alternative connection method of this invention is illustrated in FIGS. 9A and 9B, in which, after the laying of the connection terminal 45, according to FIG. 8C of the third alternative connection method, the connection terminal 45 is fished by use of the remote operation tool 73, from the supply boat 65, releasing thus the rig 64 (FIG. 9A). The connection terminal 45 is thereafter coupled to the manifold 38 with the final adjustment easily made by the thrusters 74 of the remote-operation tool 73 (FIG. 9B). The retrieval of the supporting structure 53 is not shown in FIGS. 9A, 9B and the interconnection of the adjacent well 37 to the manifold 38 is according to the showing in FIG. 8H.

It must be pointed out as well that variations of the method above to lay the lines in the direction of the manifold 38 to the WCT 43 may be made, utilizing the same method and equipment units. The system as proposed herein may be embodied alternatively by the proven traditional pull-in methods, in which the connection terminal becomes a pull-in head and the approach of the pull-in head, and where the connection to the manifold 38 are achieved by the use of usual tools and techniques.

I claim:

1. A subsea production system comprising:

a base structure (36);

a removable manifold (38) mounted on said base structure, said base structure mounting thereon connection base (46), valve modules (40), connection system lines (44, 66), and connection terminals (39, 45) for interconnecting said valve modules (40);

said system further comprising:

a plurality of adjacent satellite wells (37) equipped with lay-away type wet christmas trees (WCT's) (43);

said connection terminals (45) comprising in a lower portion thereof a hydraulic type connector (47), a swivel (48) provided laterally on said hydraulic type connector (47) for connecting one of said lines (44) of the satellite wells (37) to said hydraulic type connector (47), said lines (44) including bending restrictors (49) and, said hydraulic type connectors each having in an upper portion thereof a reentry mandrel (50);

a supporting structure (53) for said connection terminals (45), said supporting structure comprising a lower mud mat (54), a central waiting mandrel (55) and a lateral structure (56), said lateral structure (56) being equipped with eyelets (57), and said supporting structure further comprising an upper reentry funnel (58); and wherein said connection system lines (44) are provided with flexible extremities facilitating the interconnection of said satellite wells (37) to said manifold (38).

2. A subsea production system according to claim 1, wherein said wet christmas trees (43) comprise maneuver valves to simplify the manifold (38) and to render said manifold more reliable and to permit connection operations to be performed without the need for guide-cables.

3. A subsea production system according to claim 1, wherein said reentry mandrel (50) is centrally and at a top of said connector terminal (45), and said connection terminal (45) further comprises a lower (60) reentry funnel (60) mounted to said hydraulic type connector, said lower reentry funnel is centrally of said waiting mandrel (55) at an upper portion of said mud mat (54), and said upper reentry funnel is at an upper portion of said lateral structure and centered laterally between said eyelets (57).

4. A subsea production system according to claim 1, wherein the connection terminals (45) are pull-in heads thereby permitting, after abandonment of the terminals on the marine ground, pulling of said pull-in heads via pull-in tools.

5. A subsea production system according to claim 3, wherein the lower reentry funnel (60) and the upper reentry funnel (58) match the top of the WCT (43) of a satellite well (37), and said reentry mandrels (50) of said connection terminals (45) are identical to reentry mandrels (50) at the top of the WCT (43).

6. A method for making line connections between a manifold (38) and adjacent satellite wells (37) comprising the following steps:

laying a well/manifold interconnection line (66) by means of a supply boat (65) by moving said supply boat towards a manifold (38);

abandoning said interconnection lines (66) with a connection terminal (45) and a supporting structure (53) at one extremity of said lines, after installing a WCT (43) by a rig (64) at a satellite well (37);

removing said supply boat (65) after the laying of the interconnection lines (66) with the connection terminal (45) and a supporting structure (53) at one extremity of said lines on the marine ground, while operating said rig (64) on said WCT (43) of the satellite well (37);

moving said rig (64) towards said manifold (38), once the line (66) connection is completed to fish said connection terminal (45) to a completion riser (68) and a WCT installation tool (69);

coupling said connection terminal (45) by the WCT installation tool (69) and the completion riser (68);

hoisting said connection terminal (45) from said supporting structure (53) of said connection terminal, and coupling said connection terminal (45) to said manifold (38);

thereafter testing the line connection; and retrieving the supporting structure (53) by the rig (64) via cables (70) through assistance of a ROV (71), thereby completing the line interconnection of an adjacent satellite well (37) to said manifold (38).

7. A method for making line connections between a manifold (38) and adjacent satellite wells (37) comprising the following steps:

suspending from a rig (64), a wet christmas tree (WCT) (43) via a first suspension line (68) at a position of a satellite well (37), the WCT (43) coupled to one extremity of a well/manifold interconnection line (66);

hoisting a connection terminal (45) and a connection terminal supporting structure (53) mounted to and beneath the connection terminal (45) to said rig (64) by means of an auxiliary cable (75) originating from an auxiliary winch (76) installed on board the rig (64) with said connection terminal (45) coupled to a second extremity of said well/manifold interconnection line (66);

installing the WCT (43) on the satellite well (37) with the connection terminal (45) and the supporting structure (53) of the connection terminal hanging from the rig (64);

once the installation of the WCT (43) on the well (37) is completed, decoupling the completion riser (68) and the WCT installation tool (69) from the WCT (43) on the well (37);

moving the rig (64) in the direction of the manifold (38) suspended by the auxiliary cable (75) and laying the connection terminal (45) with the supporting structure (53) at said second extremity of said well/manifold interconnection line (66) with the supporting structure (53) of the connection terminal (45) onto a marine ground;

decoupling of the auxiliary cable (75) from said connection terminal (45);

recoupling of the completion riser (68) via said WCT installation tool (69) to said connection terminal (45);

hoisting the connection terminal (45) from the supporting structure (53) and coupling said connection terminal (45) to one terminal of the manifold (38);

thereafter testing the connection between said connection terminal (45) and said one terminal of said manifold (38); and retrieving the supporting structure (53) of the rig (64) via cables (70) through assistance of a ROV (71), thereby completing the line interconnection of the satellite well (37) to said manifold (38).

8. A method for making line connections between a manifold (38) and adjacent satellite wells (37) comprising the following steps:

hoisting a connection terminal (45) and an underlying supporting structure (53) of the connection terminal (45) by a rig (64) by means of an auxiliary cable (75) originating from an auxiliary winch (76) installed on board said rig (64);

suspending a wet christmas tree (WCT) (43) from said rig (64) by a completion riser (68) terminating in a WCT installation tool (69) coupled to said WCT (43);

effecting coupling of the opposite extremities of said well/manifold interconnection line (66) to said connection terminal (45) and said WCT (43) respectively;

installing the WCT (43) on the well (37) by lowering said completion riser (68) with the connection terminal (45) and the connection terminal supporting structure (53) hanging from the rig (64);

once the installation of the WCT (43) on said satellite well (37) is completed, decoupling the WCT installation tool (69) from the WCT (43);

laying the well/manifold interconnection line (66) by moving said rig (64) towards said manifold (38) and lowering said auxiliary cable to place the connection terminal (45) and the supporting structure (53) on the marine ground, thereby laying of the connection terminal (45) and the supporting structure (53) thereof on the marine ground;

after laying of the connection terminal (45) fishing said connection terminal (45) by a remote-operation tool (73) from a supply boat (65) after decoupling of the auxiliary cable (75) from the connection terminal (45) and releasing the rig (64);

hoisting the connection terminal (45) from the supporting structure (53) to a position overlying said manifold (38) and finally adjusting the position of the connection terminal (45) relative to the manifold (73), thereby coupling the connection terminal (45) to the manifold (38) through said remote-operation tools (73);

thereafter testing the connection between the connection terminal (45) and the manifold (38); and retrieving the supporting structure (53), thus completing the line interconnection of the adjacent well (37) to said manifold (38).

* * * * *